US005186034A

United States Patent [19]

Hunt

[11] Patent Number: 5,186,034

[45] Date of Patent: Feb. 16, 1993

[54] AIR CENTER MACHINE WITH PITCH ADJUSTMENT

[75] Inventor: Terry J. Hunt, Lockport, N.Y.

[73] Assignee: General Motors Corporation, Detroit, Mich.

[21] Appl. No.: 822,236

[22] Filed: Jan. 17, 1992

[51] Int. Cl.[5] ..... B21D 13/04

[52] U.S. Cl. ..... 72/187; 72/226

[58] Field of Search ..... 72/187, 196, 226

[56] References Cited

U.S. PATENT DOCUMENTS

| | | | |
|---|---|---|---|
| 1,018,399 | 2/1912 | Livingston . | |
| 2,179,849 | 11/1939 | Freeze | 72/226 |
| 3,791,185 | 2/1974 | Knudson . | |
| 3,918,626 | 11/1975 | McLain | 72/196 |
| 4,265,103 | 5/1981 | Noack | 72/226 |
| 4,741,192 | 5/1988 | Wallis | 72/187 |
| 4,838,065 | 6/1989 | Wallis | 72/185 |
| 4,888,972 | 12/1989 | Rouse | 72/185 |

FOREIGN PATENT DOCUMENTS

| | | | |
|---|---|---|---|
| 0166824 | 6/1989 | Japan | 72/187 |

*Primary Examiner*—Lowell A. Larson

*Attorney, Agent, or Firm*—Ronald L. Phillips

[57] ABSTRACT

A machine for making corrugated fins or air centers for heat exchangers from strip stock has forming rolls, packing rolls, metering rolls and two pairs of pullout rolls, each pair having a different number of teeth to produce a different pitch of convolutions. The pairs of pullout rolls are mounted for movement apart or together under control of a cam mechanism so that one pair yielding the desired pitch can engage the centers to set the pitch while the other pair is moved apart to disengage the centers.

5 Claims, 1 Drawing Sheet

AIR CENTER MACHINE WITH PITCH ADJUSTMENT

FIELD OF THE INVENTION

This invention relates to a machine for making corrugated air centers for heat exchangers and particularly to such a machine which is adjustable for different convolution pitches.

BACKGROUND OF THE INVENTION

Automotive radiators and other heat exchangers have a series of parallel flat tubes carrying a hot fluid such as engine coolant for transfer of heat to a cooler fluid such as air which flows around the tubes. To improve heat transfer rate, sinuous or corrugated metal strips called fins or air centers are inserted in the spaces between the flat tubes and soldered or brazed at the junction of the peaks of the air centers and the tubes to assure good heat conductivity from the tubes to the fins. The tubes are assembled in the radiator at fixed spacings and the air centers then must be just the right size to fit in the spacing. Different products may have different heat transfer requirements and thus require centers with different fin spacings.

A prior practice used for obtaining centers of different fin spacings from a machine which has forming rolls for producing a set number of corrugation peaks or convolutions per unit length of strip stock is to change the tooling. A conventional way of controlling the pitch is to stuff or pack the centers such that the convolutions are touching and then stretching out the centers by pullout rolls until the desired pitch is obtained. To vary the pitch a pair of pullout rolls are removed from the machine and a different set of pullout rolls with a different number of teeth are substituted. This requires considerably machine downtime for the change-over as well as labor cost.

SUMMARY OF THE INVENTION

It is therefore an object of the invention to provide a center machine capable of changing pitch without removal and replacement of pullout rolls. It is a further object to provide such a machine which effectively changes pullout rolls through selectively positioning of rolls.

The invention is carried out by a machine for forming corrugated ribbon from sheet stock with adjustable pitch of convolutions comprising: forming rolls for producing corrugated ribbon from sheet stock; stuffing rolls for compressing the corrugated ribbon to a pitch smaller than the desired product pitch; and means for stretching the corrugated ribbon out to a desired pitch comprising metering rolls for paying out the ribbon at a controlled rate, first and second pairs of pullout rolls following the metering rolls adapted to selectively engage the payed out ribbon to form the ribbon to first and second pitches, respectively, and means for selectively engaging the pairs of pullout rolls with the ribbon to attain one of the first and second pitches.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
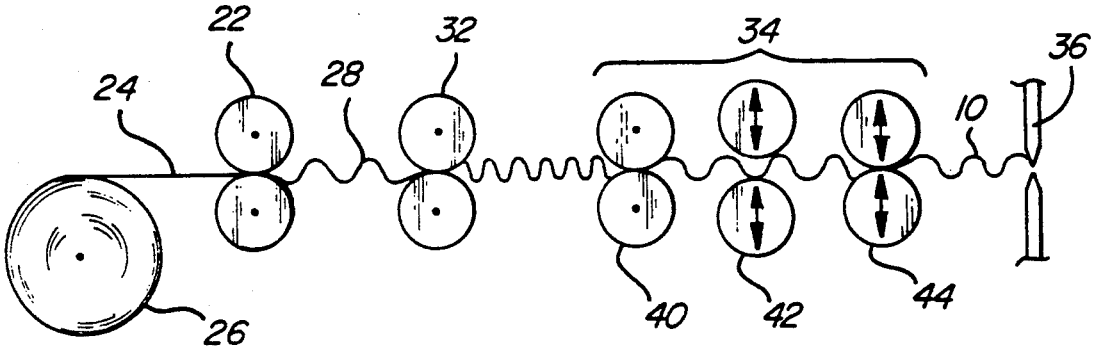
FIG. 1 is a schematic diagram of a center machine according to the invention.

The air center product to be made herein is well known for use in automotive radiators and is fashioned from thin metal stock, usually aluminum or copper ribbon. The center may be described as corrugated or sinuous in form. Typically, the air center peaks have a height on the order of 9 mm and a pitch of about 4 mm. The apparatus for forming the air center product is also known and is shown in FIG. 1 along with the improvements of this invention. In particular, the known apparatus comprises form rolls 22, resembling meshing gears, which draw strip stock 24 from a supply coil 26 and impart convolutions 28 to the strip to form the sinuous air center 10. At this point the center has the height and pitch which is determined by the rolls 22. After the air center is formed it is compressed by stuff rolls 32 such that the convolutions are touching. The center 10 is withdrawn from the compressed state by a pullout station 34. Finally, cutoff blades 36 separate the continuous air center strip 10 into individual center lengths. In this manner, the apparatus rapidly produces air centers, using stock 24 at a rate of, say, 1000 feet per minute. Prior to this invention, the pullout station has had a pair of metering rolls and a pair of pullout rolls which stretch the center to the desired pitch and then set the pitch into each convolution. The root profile of each tooth of the gear-like rolls is carefully machined to engage the center convolution and cold work the center to give it a permanent set at the correct pitch. To obtain a different pitch a different number of teeth in the rolls is required to provide the correct tooth profile. Thus to achieve a different pitch in a prior art machine, a different pair of pullout rolls would have to be installed in the machine.

The improvement of this invention lies in the pullout station 34 which has a pair of metering rolls 40, a first pair of pullout rolls 42 and a second pair of pullout rolls 44. The rolls 42 have a set number of teeth which is preferred for one pitch size of convolutions and the rolls 44 have another number of teeth to obtain a second pitch size. For example, one pair of pullout rolls has 68 teeth to yield a pitch of 3 mm per convolution and the other pair has 58 teeth to yield 3.5 mm per convolution.

Figure 2:
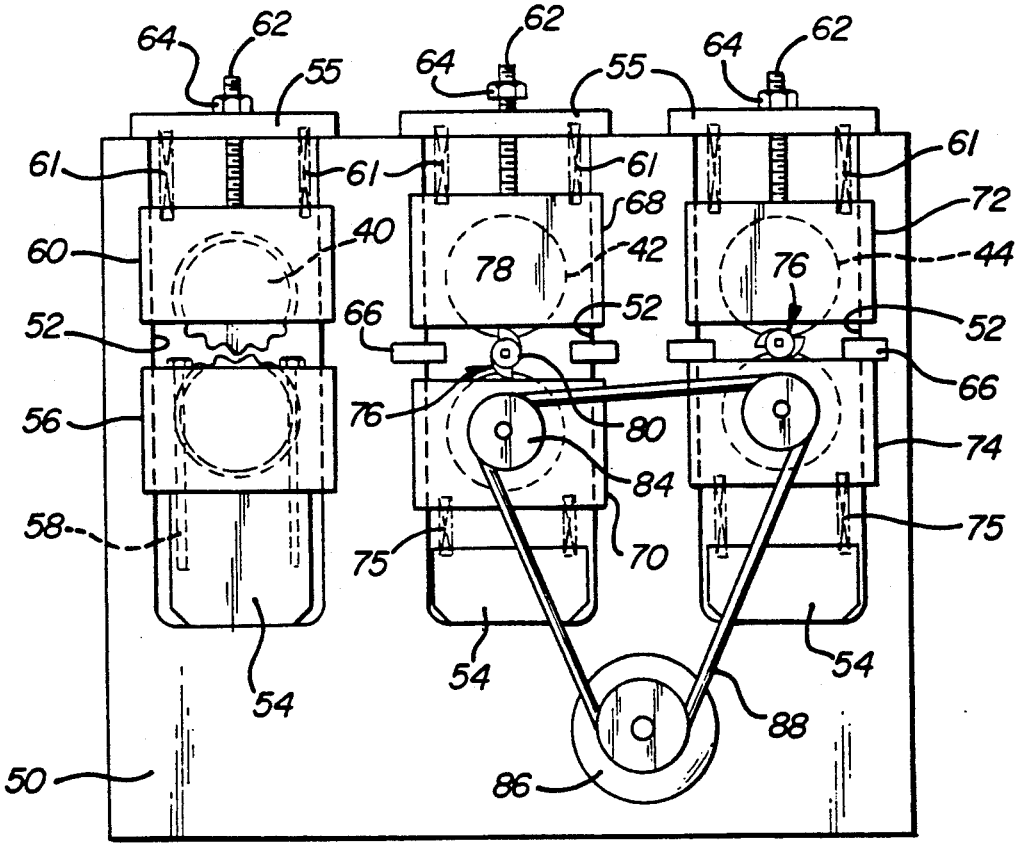
FIG. 2 is a side view of pullout rolls of the machine of FIG. 1.

As best shown in FIG. 2, the pullout rolls 42, 44 are mounted for vertical movement together and apart such that one pair of rolls is set to engage the center 10 while the other pair is spaced apart sufficiently to allow clear passage of the center. The drawing shows the first pair of pullout rolls 42 spaced apart and the other pair 44 meshing with the center 10.

One side of the pullout station is illustrated in FIG. 2. A casting 50 or an assembly of castings serves as a machine foundation and contains three vertical U-shaped openings 52 defining ways for mounting vertically movable bearing blocks which in turn support the rolls. Each opening has a base block 54 fixed at the bottom and a cap plate 55 covering the top. The first opening 52 supports the metering rolls 40 via a lower bearing block 56 which is secured by bolts 58 to the base block, and an upper bearing block 60 which is urged downward by compression springs 61 seated in the cap plate 55 such that the rolls 40 are pressed to a work position to act on the convoluted strip passing through the station. A stud 62 threaded into the top of the upper block 60 and extending through an aperture in the cap plate 55 has an adjustable nut 64 above the plate which is positioned to establish the lower limit of the bearing block 60 and associated roll 40. Drive mechanism, not shown, rotates the rolls 40 at a desired rate to meter the corrugated center to the pullout rolls.

The second and third openings contain the first and second pairs of pullout rolls 42 and 44, respectively, and have similar bearing blocks and the upper bearing blocks have similar position limiting means. Thus upper bearing blocks 68 and lower bearing blocks 70 carry the rolls 42 while upper bearing blocks 72 and lower bearing blocks 74 carry the rolls 44. The lower bearing blocks 70 and 74 are urged upwardly by compression springs 75 seated in the base blocks. A fixed stop 66 on each side of the opening abuts the lower bearing blocks 70 and 74 to limit their upward travel. To effect the separation of the rolls 42 and 44 for disengaging the center 10, a cam 76 is positioned between the respective bearing blocks. The cam 76 is elongated with two curved lobes 78 extending oppositely from a central hub 80. When the major dimension of the cam extends horizontally, as shown between the bearing blocks 72 and 74, the cam does not affect the bearing block positions and the rolls 44 engage the center. On the other hand, when the cam is rotated 90° to a vertical orientation, as shown between the bearing blocks 68 and 70, the lobes 78 of the cam push apart the bearing blocks against the springs 58 and 61 to disengage the rolls 42 from the center. Each cam hub 80 has a square outboard extension 82 to receive a wrench for cam rotation.

The lower pullout roll of each pair has a timing gear 84 driven by a servomotor 86 through a common timing belt 88. Thus the lower rolls rotate continuously when the servomotor is operating. The pullout rolls which engage the center also engage each other so that the upper roll is driven by the lower roll. The pullout rolls which are cammed apart do not engage each other and the lower roll just idles. When one of the lower pullout rolls is lowered and the other is raised, the belt 88 remains at the original tension because both rolls move by the same amount but in opposite directions.

In operation, the cams 76 are adjusted to set one pair of pullout rolls 42 or 44 into engagement and the other pair out of engagement to select the desired pitch size. A center 10 is started in the rolls and adjusted to attain the same pitch in the center between the metering rolls 40 and the selected pullout rolls. Then the metering rolls 40 as well as the forming and packing rolls 22, 32 are rotated at desired speeds and the servomotor 86 is run at a speed sufficient to process the center at the same rate (convolutions per second) as the metering rolls. Then the pitch of the center between the metering and pullout rolls will remain at a constant value. If a different pair of rolls were engaged with the center, the servomotor would have to run at a different speed to accommodate the different number of teeth. The action of the pullout rolls on the center sets the pitch into each convolution of the center.

It will thus be seen that the apparatus for producing air centers of different pitches lends to rapid and easy conversion from one pitch to another.

The embodiments of the invention in which an exclusive property or privilege is claimed are defined as follows:

1. A machine for forming corrugated ribbon from sheet stock with adjustable pitch of convolutions comprising:

forming rolls for producing corrugated ribbon from sheet stock;

stuffing rolls for compressing the corrugated ribbon to a pitch smaller than the desired product pitch; and means for stretching the corrugated ribbon out to a desired pitch comprising metering rolls for paying out the ribbon at a controlled rate, first and second pairs of pullout rolls following the metering rolls adapted to selectively engage the payed out ribbon to form the ribbon to first and second pitches, respectively, and means for selectively engaging the pairs of pullout rolls with the ribbon to attain one of the first and second pitches.

2. The invention as defined in claim 1 wherein the ribbon passes through both pairs of pullout rolls and the pullout rolls of each pair are movable together and apart to respectively engage and disengage the ribbon.

3. The invention as defined in claim 1 wherein the pairs of pullout rolls have different numbers of teeth, each according to the desired pitch.

4. The invention as defined in claim 3 including motor means for driving both pairs of pullout rolls, wherein the motor speed is adjustable in accordance with the number of teeth of the engaged pullout rolls to maintain the same rate of feed as the metering rolls.

5. The invention as defined in claim 1 including motor means coupled to both pairs of pullout rolls to maintain a correct rate of feed of the ribbon.

* * * * *